US006834726B2

(12) United States Patent
Giroux et al.

(10) Patent No.: US 6,834,726 B2
(45) Date of Patent: Dec. 28, 2004

(54) METHOD AND APPARATUS TO REDUCE DOWNHOLE SURGE PRESSURE USING HYDROSTATIC VALVE

(75) Inventors: Richard Giroux, Cypress, TX (US); David M. Haugen, League City, TX (US); David Hosie, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 31 days.

(21) Appl. No.: 10/157,743

(22) Filed: May 29, 2002

(65) Prior Publication Data

US 2003/0221837 A1 Dec. 4, 2003

(51) Int. Cl.[7] ..... E21B 43/12; E21B 34/06; E21B 34/08

(52) U.S. Cl. ..... 166/386; 166/320; 166/332.4; 166/334.4; 166/373

(58) Field of Search ..... 166/373, 381, 166/386, 316, 317, 318, 319, 320, 332.1, 332.4, 334.1, 334.4

(56) References Cited

U.S. PATENT DOCUMENTS

| | | | | | |
|---|---|---|---|---|---|
| 2,947,363 | A | | 8/1960 | Sackett et al. | 166/244 |
| 3,051,244 | A | | 8/1962 | Litchfield | 166/225 |
| 3,376,935 | A | | 4/1968 | Baker | 166/224 |
| 3,970,176 | A | | 7/1976 | Bucksch | 192/87.11 |
| 4,044,829 | A | | 8/1977 | Jessup et al. | 166/264 |
| 4,448,254 | A | * | 5/1984 | Barrington | 166/373 |
| 4,512,406 | A | * | 4/1985 | Vann et al. | 166/297 |
| 4,552,218 | A | * | 11/1985 | Ross et al. | 166/319 |
| 4,564,076 | A | * | 1/1986 | Vann et al. | 175/4.52 |
| 4,893,678 | A | | 1/1990 | Stokley et al. | 166/374 |
| 5,203,414 | A | * | 4/1993 | Hromas et al. | 166/382 |
| 5,244,044 | A | | 9/1993 | Henderson | 166/332 |
| 5,263,683 | A | * | 11/1993 | Wong | 251/145 |
| 5,316,084 | A | * | 5/1994 | Murray et al. | 166/332.4 |
| 5,341,883 | A | | 8/1994 | Ringgenberg | 166/324 |
| 5,664,629 | A | * | 9/1997 | Maitland | 166/373 |
| 5,743,331 | A | | 4/1998 | Adkins et al. | 166/55.7 |
| 5,819,813 | A | | 10/1998 | Dewispelaere | 139/455 |
| 5,960,881 | A | | 10/1999 | Allamon et al. | 166/291 |
| 6,116,336 | A | | 9/2000 | Adkins et al. | 166/55.7 |
| 6,182,766 | B1 | | 2/2001 | Rogers et al. | 166/386 |
| 6,293,342 | B1 | * | 9/2001 | McGarian et al. | 166/317 |
| 6,296,058 | B1 | * | 10/2001 | Brieger | 166/311 |
| 6,390,200 | B1 | * | 5/2002 | Allamon et al. | 166/376 |
| 6,508,312 | B1 | * | 1/2003 | Latiolais et al. | 166/386 |
| 2001/0017210 | A1 | | 8/2001 | Howlett | 166/285 |
| 2001/0045288 | A1 | * | 11/2001 | Allamon et al. | 166/373 |
| 2002/0074128 | A1 | * | 6/2002 | Allamon et al. | 166/373 |
| 2003/0024706 | A1 | * | 2/2003 | Allamon | 166/373 |
| 2003/0136563 | A1 | * | 7/2003 | Allamon et al. | 166/386 |

FOREIGN PATENT DOCUMENTS

| | | | |
|---|---|---|---|
| EP | 0 787 888 | 8/1997 | E21B/21/10 |
| EP | 0 969 181 | 1/2000 | E21B/21/10 |

OTHER PUBLICATIONS

PCT International Search Report, International Application No. PCT/US 03/16800, dated Oct. 27, 2003.

* cited by examiner

*Primary Examiner*—David Bagnell
*Assistant Examiner*—Jennifer H Gay
(74) *Attorney, Agent, or Firm*—Moser, Patterson & Sheridan

(57) ABSTRACT

An apparatus for reducing pressure surges in a wellbore comprising a body having a bore therethrough, the bore providing a fluid path for wellbore fluid between a first and second end of the body, at least one fluid path permitting the wellbore fluid to pass between the bore and an annular area formed between an outer surface of the body and the walls of a wellbore therearound, and a number of closure mechanisms whereby the at least one fluid path is selectively closable to the flow of fluid.

12 Claims, 12 Drawing Sheets

METHOD AND APPARATUS TO REDUCE DOWNHOLE SURGE PRESSURE USING HYDROSTATIC VALVE

BACKGROUND OF THE INVENTION

1. Field of the Invention

The present invention generally relates to an apparatus and a method for reducing downhole surge pressure while running a liner into a wellbore. More particularly, the invention relates to an apparatus and a method for reducing surge pressure by opening and closing ports to allow fluid and mud flow to flow within an annulus between the wellbore and a circulation tool.

2. Description of the Related Art

For a long time, the oil-well industry has been aware of the problem created when lowering a liner string at a relatively rapid speed in drilling fluid. This rapid lowering of the liner string results in a corresponding increase or surge in the pressure generated by the drilling fluid below the liner string. A liner string being lowered in to a wellbore can be analogized to a tight fitting plunger being pushed in to a tubular housing. Although there is a small annular clearance between the liner and the wellbore, the fluid bypass rate is limited. The faster the liner is lowered, the more fluid builds up below it due to the limited bypass and this creates an increased pressure or surge below the liner as it is lowered in to the wellbore. Of particular concern is surge related damage due to exposed formation below the liner string.

This surge pressure has been problematic to the oil-well industry in that it has many detrimental effects. Some of these detrimental effects are 1) lost volume of drilling fluid; it is not unheard of to lose 50,000 or more barrels of fluid while running the liner, wherein present costs are $40 to $400 a barrel depending on its mixture, 2) resultant weakening and/or fracturing of the formation when this surge pressure in the borehole exceeds the formation fracture pressure, particularly in highly permeable formations, 3) loss of cement to the formation during the cementing of the liner in the borehole due to the weakened and, possibly, fractured formations which result from the surge pressure on those formations, and 4) differential sticking of the drill string or liner being run into a formation during oil-well operations, that is, when the surge pressure in the borehole is higher than the formation fracture pressure, the loss of drilling fluid to the formation allows the drill string or liner to be pulled against the permeable formation downhole thereby sticking the drill string or liner to the permeable formation.

This surge pressure problem is further exasperated when running tight clearance liners or other apparatus in the existing casing. For example, clearances between a typical liner's Outer Diameter (O.D.) and a casing's Inner Diameter (I.D.) are ½" to ¼". The reduced annular area in these tight clearance liner runs results in correspondingly higher surge pressures and heightened concerns over their resulting detrimental effects.

Typically, surge pressures are minimized by decreasing the running speed of the drill string or liner downhole to maintain the surge pressures at acceptable levels. An acceptable level is a level at least where the drilling fluid pressure, including the surge pressure, is at least less than the formation fracture pressure. The problem with decreasing running speed is that more time is required to complete the liner placement. That is economically disadvantageous in today's environment where drilling rig rates can be as high as $300,000.00 per day.

U.S. Pat. No. 5,960,881, discloses a downhole surge pressure reduction system to reduce the pressure buildup while running in liners. The surge reduction device disclosed therein is located immediately above the top of the liner. Plugging of the float valve at the lower end of the liner can, render the surge pressure reduction system of the '881 patent ineffective.

U.S. Pat. No. 2,947,363, proposes a fill-up valve for well strings that includes a movable sleeve in a housing. As taught by the '363 patent, after a predetermined amount of fluid has been admitted, a ball is dropped on the sleeve and pressure applied to move the sleeve downwardly to misalign the ports to a closed port position. Fingers on the sleeve are stated to interlock with teeth to stop upward movement of the sleeve. While the ball could be moved up the housing by an upward flow of pressurized fluid, the ball cannot be blown or forced downwardly through the sleeve. Therefore, this fill-up valve does not provide full opening for inner drill string work to be accomplished at a depth below the fill-up valve.

U.S. Pat. No. 3,376,935, proposes a well string that is partially filled with fluid during a portion of its descent into a well and, thereafter, selectively closed against the entry of further fluid while descent of the well string continues ('935 patent, col. 1, Ins. 25 to 47). As best shown in FIGS. 3 to 5 of the '935 patent, a ball seats on a ball seat to move the sleeve downwardly to a closed port position. Upon a predetermined pressure the seat deforms, as shown in FIG. 5, to allow the ball to pivot the flapper valve downwardly and pass out of the housing 3 ('935 patent, col. 6, Ins. 32 to 60). The flapper check valve prevents flow of fluid (e.g. drilling fluid) up through the housing ('935 patent, col. 4, Ins. 60 to 73), whether or not the sleeve is in the open port position (FIG. 3) or the closed port position (FIGS. 2, 4 and 5). Additionally, as best shown in FIGS. 1 and 2, the inside diameter of the sleeve is less than the inside diameter of the drill string or pipe interior, thereby creating a restriction in the string. While this tool allows movement of fluids from the annulus, adjacent the ports of the tool, to flow up the drill string, the surge pressure created by apparatus uses, below the tool, is not alleviated.

U.S. Pat. No. 4,893,678, proposes a multiple-set downhole tool and method of use of the tool. While confirming the oil-well industry desire for "full bore" opening in downhole equipment, the '678 patent proposes the use of a ball to move a sleeve to misalign a port in the sleeve and a passage in the housing. Additionally, while the ball can even be "blown out," the stated purpose of the apparatus in the '678 patent is to activate a tool, and more particularly, to inflate an elastomeric packer ('678 patent, col. 1, Ins. 20 to 25 and col. 3, In. 14 to col. 4, In. 42), not to reduce surge pressure while running a drill string with a casing liner packer or other apparatus downhole.

A Model "E" "Hydro-Trip Pressure Sub" No. 799–28, distributed by Baker Oil Tools, a Baker Hughes company of Houston, Tex., is installable on a string below a hydraulically actuated tool, such as a hydrostatic packer to provide a method of applying the tubing pressure required to actuate the tool. To set a hydrostatic packer, a ball is circulated through the tubing and packer to the seat in the "Hydro-Trip Pressure Sub," and sufficient tubing pressure is applied to actuate the setting mechanism in the packer. After the packer is set, a pressure increase to approximately 2,500 psi shears screws to allow the ball seat to move down until fingers snap back into a groove. The sub then has a full opening, and the ball passes on down the tubing.

U.S. Pat. No. 5,244,044, proposes a similar catcher sub using a ball to operate pressure operated well tools in the conduit above the catcher sub. However, neither the Baker nor the '044 tool provides for reduction of surge pressure by diverting fluid flow into the annulus between the drill string and casing.

SUMMARY OF THE INVENTION

The present invention relates to a downhole surge pressure reduction system for use in the oil-well industry. Typically, the tool that is the subject of the invention is disposed at an upper end of a string of tubulars or liner to be cemented in a wellbore. Installed below the tool is typically a liner hanger running tool that temporarily holds the liner string in the wellbore prior to cementing.

More specifically, this invention relates to an apparatus and a method for reducing surge pressure while running tubulars into a wellbore. In one embodiment, the invention provides a means of pre-selecting a desired hydrostatic wellbore pressure at which a rupture disc will burst causing wellbore fluid to activate a piston that will seal a number of bypass ports. With the piston activated, the tool is effectively closed, and the circulation tool may proceed with cementing or other needed processes.

Alternatively, the tool may be closed by shearing a breakable plug. Shearing of the breakable plug allows fluid to activate the piston in the same manner as if a rupture disc had burst. Both the rupture disc and the breakable plug, or knock-off plug, are forms of frangible members.

In other embodiments, the tool comprises numerous closure members for sealing the circulation or bypass ports. Particularly, these closure members may consist of a breakable piston sleeve or a sleeve lowered or dropped from the surface. Also required is a closing mechanism that consists of the closure member as well as the equipment required to orient and place the closure member. As envisioned, the tool may be closable by more than one method. Thus, it is one object of this invention to provide a tool capable of reducing pressure surges in a wellbore wherein the tool itself is selectively closable.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are not to be considered limiting of its scope, for the invention may admit to other equally effective embodiments.

DETAILED DESCRIPTION OF THE PREFERRED EMBODIMENT

Figure 1:
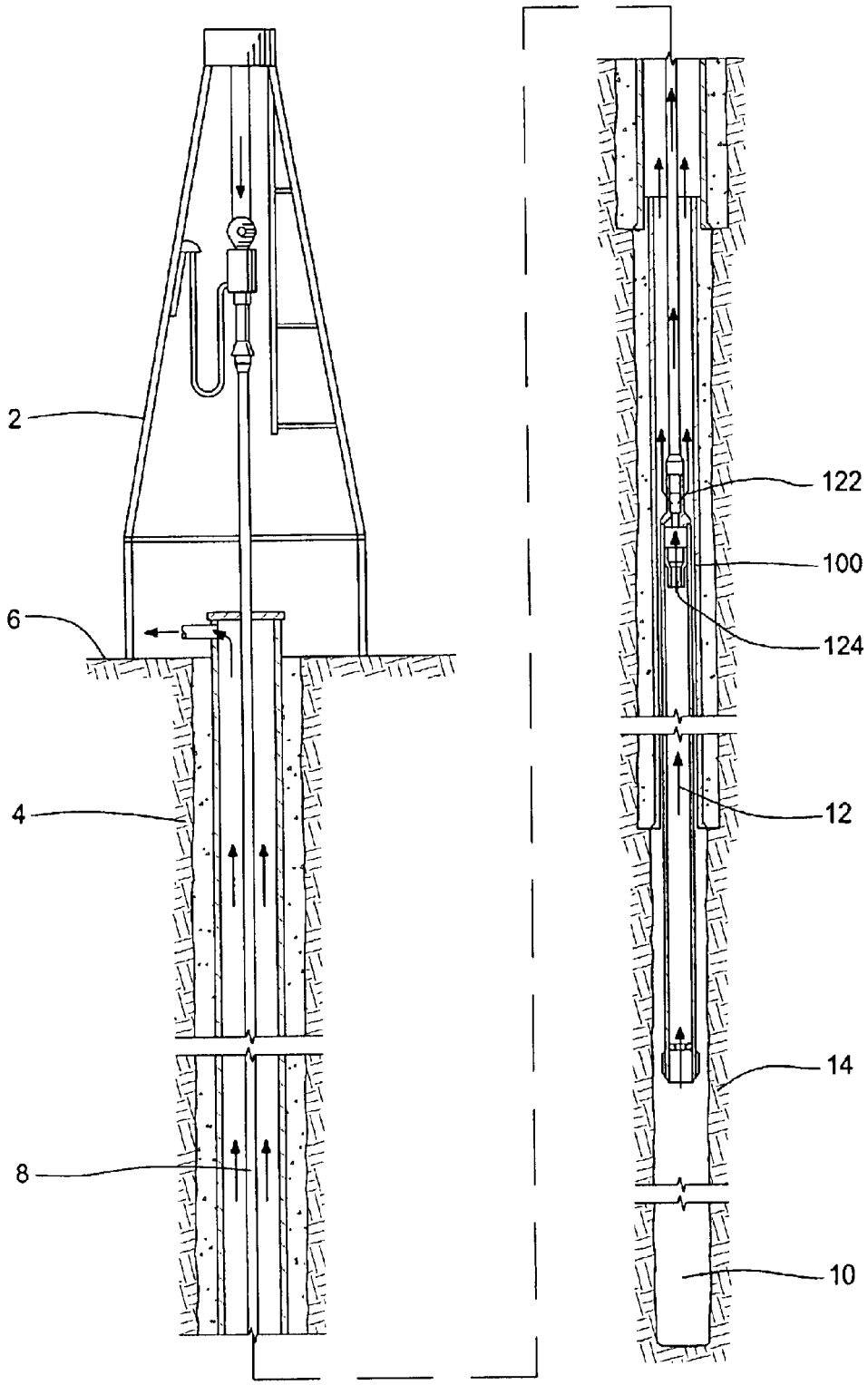
FIG. 1 is an elevation view of the present invention schematically showing the circulation tool described herein located within a representative borehole.

Generally shown in FIG. 1 are some of the components of the system of the present invention. Visible are a representative rig 2 at the surface 6 of the earth, a borehole 10, a formation 4, an exposed formation 14, and a working string 8 above the tool of the present invention 100. Schematically, fluid flows 12 through the bore 124 of the tool 100 and out the bypass ports 122 if open.

Figure 2:
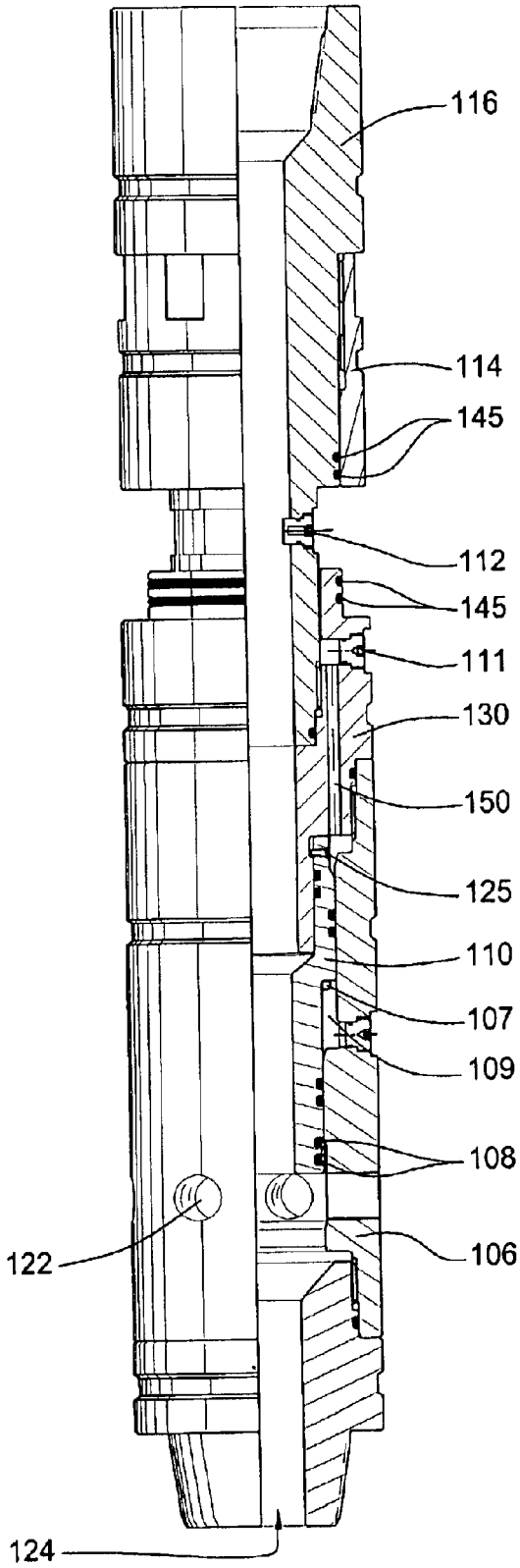
FIG. 2 is a partial section view of a single operation tool, envisioned in one embodiment of this invention, prior to make-up. As shown, the threaded sleeve is in an open position allowing an operator access to the rupture disc, not shown, and a knock-off pin, or break plug. Also visible are the bypass ports in an open position.

FIG. 2 is a partial section view of a single operation tool 100 prior to make-up. As shown, the tool 100 comprises a bore 124 that provides a path for wellbore fluid to flow through the interior of the tool 100. At a lower end of the tool 100 are a series of bypass ports 122 that when open, as shown, allow a portion of the fluid entering the tool 100 to be diverted into an annulus between the drill string and casing (not shown). It is this additional fluid flow around the outer diameter of the tool 100 that reduces the induced surge pressure as the tool and a string of liners are run into a wellbore full of fluid.

At an upper end of the tool 100 is located a rupture disc (not shown) that can be selected to burst at a predetermined pressure correlating to a predetermined depth within the wellbore. The rupture disc, a frangible member, fails due to a pressure differential between the wellbore fluid and an upper atmospheric chamber (not shown) formed around the rupture disc when the access sleeve 114 is closed. In operation, an operator would select the depth at which he needs the circulating tool to close, and from that he could correlate the pressure at which that depth would be associated with given all the known fluid and wellbore factors. The rupture disc 120 and knock-off pin 112 can be installed, inspected, and changed on the rig floor or anytime prior to the tool 100 being lowered into the wellbore.

Also at the upper end of the tool 100 is an access sleeve 114 that is threadedly connected to the tool 100 and covers a knock-off pin 112 and the rupture disc. Surrounding the pin and rupture disc are a series of upper and lower o-rings 145 that seal the upper atmospheric chamber 113 when the access sleeve 114 is in the closed position.

The knock-off pin 112, another frangible member that is also known as a break plug, is designed to be a fail-safe to the rupture disc 120, a back-up that if needed can be sheared by a shear-bar or tube 128 (FIG. 5) or similar device, known to those in the field. In this manner the bypass ports 122 are designed to be redundantly closeable, that is closeable by more than one means.

Figure 3:
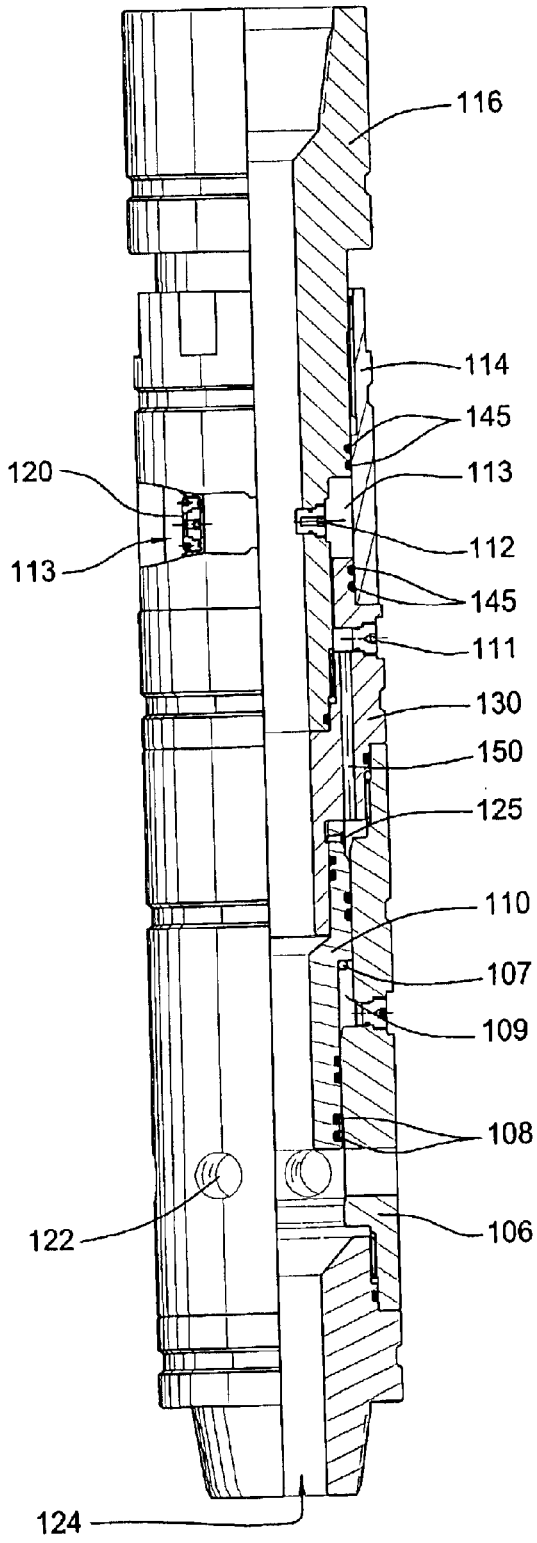
FIG. 3 is a partial section view of a single operation tool, envisioned in one embodiment of this invention, after make-up. This view is also representative of the tool in use downhole prior to rupturing of the disc, and actuation of the piston. Also visible are the bypass ports in an open position.

FIG. 3 is a partial section view of the single operation tool 100 after make-up. The tool is made-up by installing the pre-selected rupture disc 120 and break plug 112, then threadedly closing the sleeve in order to form the atmospheric chamber 113. Visible is the rupture disc 120 located adjacent to the knock-off pin 112. In this view, the access sleeve 114 has been lowered, closed, or sealed; and, the tool is now ready to be run into a wellbore with a string of liners.

The access sleeve 114 is threadedly connected to the tool 100 between the flow housing 130 and an upper sub 116 of the tool 100 and allows access to the break plug 112 and rupture disc 120. In the open position both the disc 120 and the break plug or pin 112, can be inspected, changed, removed, etc. In the closed position the access sleeve 114 seals off the pin and disc from external pressures and only allows inner wellbore fluid to act on them. Also of significance is that the access sleeve 114, when closed, creates the flow cavity 113. The flow cavity 113 is the annulus between the outer edge of the rupture disc 120 and the inner wall of the access sleeve 114. This flow cavity 113 is linked to a flow path 150 that allows the fluid to act on a piston 110 and a piston set pin 125. To further seal the flow cavity 113 there are a series of o-rings 145, or other similar sealants, located above and below the flow cavity 113. Further, a plug 111 may permit fluid access to the cavity 113 during assembly of the tool 100 and later seal the cavity 113 from external pressures.

In normal operation, the fluid, at a pre-set pressure would flow through the rupture disc 120 and into the flow cavity 113. From there the fluid passes into the flow path 150 to actuate the piston 110. Alternative to the rupture disc 120, a shear bar 128 could be dropped from the surface and thus actuate the fluid flow through the knock-off pin 112 and into the flow cavity 113. The piston 110 is actuated when the fluid pressure overcomes the piston set pin 125 force holding the piston 110 to the flow housing 130. Once this preset force is overcome, the piston 110 moves downward until its shoulder 140 comes to rest against the lower sub 106. A bumper ring 107 attached to the piston's shoulder 140 makes contact with the lower sub 106 and this ring 107 cushions and dampens the vibrations caused by the piston 110 impacting the lower sub 106. When the shoulder 140 of the piston is sitting on the lower sub 106, the lower portion of the piston 110 having o-rings 108 disoosed thereon effectively seals the bypass ports 122.

After fluid enters the flow cavity 113 through either the void caused by the burst of the rupture disc 120 or by the knock-off pin's 112 interior annulus, the fluid will flow through the flow cavity 113 and into the flow path 150 to act on the top of the piston 110. The piston 110, when not acted upon by the wellbore fluid pressure, is held in place by a piston set pin 125 attached to a non-moving flow housing 130. Once fluid enters the flow path 150, the fluid pressure will cause the piston set pin 125 to shear thus releasing the piston 110 in a rapid downward motion. The piston's shoulder 140 will bottom out on a lower sub 106, located above the bypass ports 122. The piston 110 accordingly seals the bypass ports 122 and fluid flow is then only permitted through the bore 124 of the tool 100.

Figure 4:
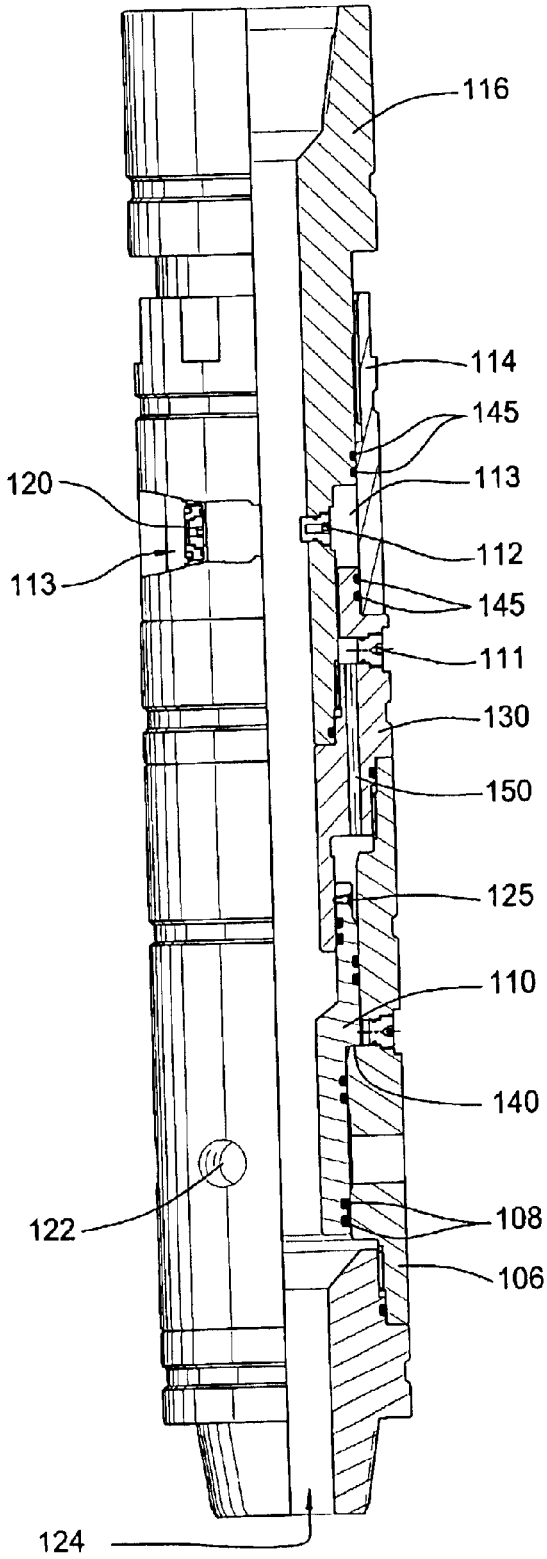
FIG. 4 is a partial section view of a single operation tool, envisioned in one embodiment of this invention, after the rupture disc has blown, and showing the piston in its downward position closing off the bypass ports.

FIG. 4 is a side view of the same single operation tool after the rupture disc 120 has burst, and showing the piston 110 in its downward position sealing off the bypass ports 122. The piston 110, as shown, has bottomed-out and its shoulder 140 is resting on the lower sub 106. In this position, the piston 110 effectively closes the bypass ports 122 and prevents further fluid from flowing into the annulus by way of the ports 122.

Figure 5:
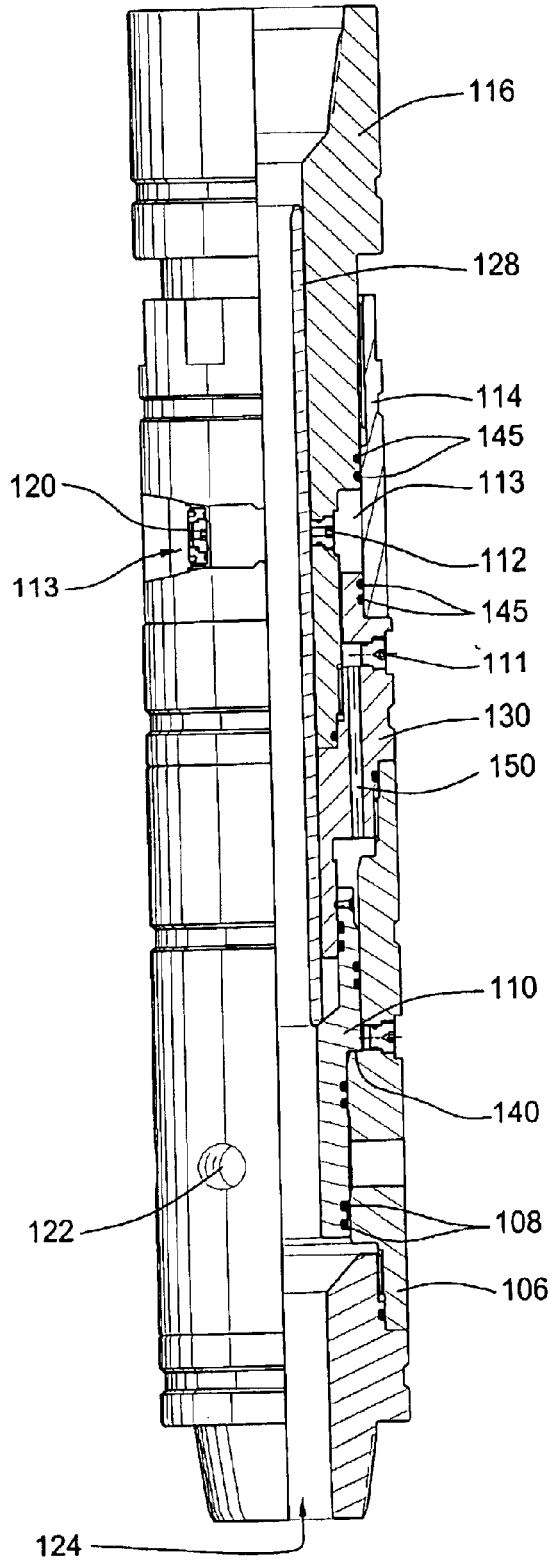
FIG. 5 is a partial section view of a single operation tool, envisioned in one embodiment of this invention, with a shear bar used to shear the knock-off pin as an alternative method to allow fluid flow into the cavity.

FIG. 5 shows a side view of an alternative method, or redundant manner, of operating the tool by means of a shear bar 128 used to shear the knock-off pin 112 and allow fluid flow into the flow cavity 113. In this view the fluid has entered the flow cavity 113 by way of the inner annulus or bore of the knock-off pin 112. From there the fluid flows and acts on the piston in the same manner as if it had burst the rupture disc 120. The shear bar 128 is generally annular in nature.

Figure 6:
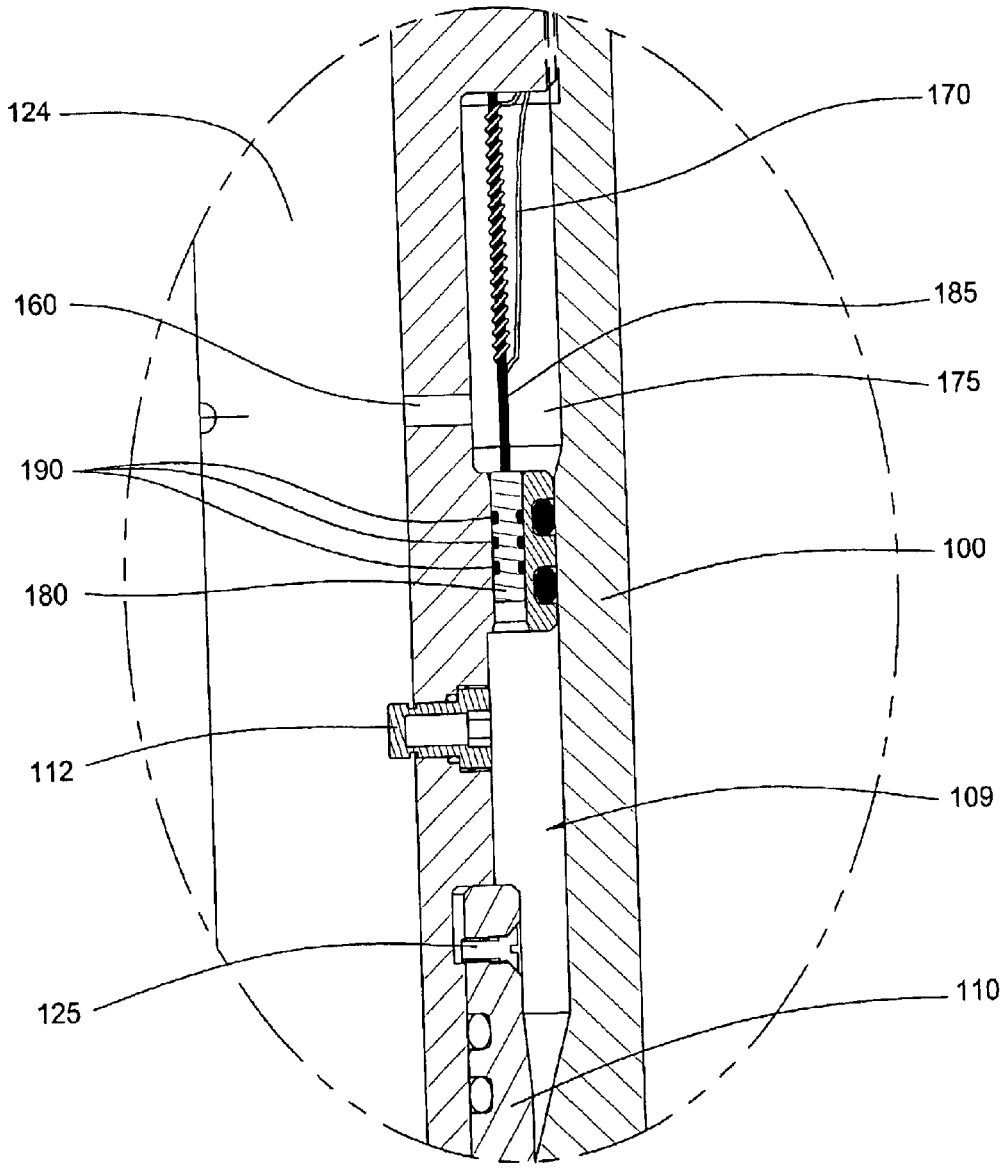
FIG. 6 is a partial section view of an electrically operated single operation tool, a separate embodiment of the present invention.

FIG. 6 is a partial section view of an electrically operated single operation tool. In this embodiment, the tool 100 is remotely shifted to a closed position due to the response of an electric signal. As with the preferred embodiment described above, this tool goes in the hole in an open position.

In this embodiment, a series of ports 160 connect the bore 124 with a hydrostatic pressure chamber 175. The hydrostatic pressure chamber 175 contains a heating coil 170 and a wire 185 holding a frangible member, in this instance, a small piston 180. The upper surface of the small piston 180 forms the lower boundary of the hydrostatic pressure chamber 175. As named, the hydrostatic pressure chamber 175 fills with fluid and maintains the pressure of that fluid which is the same pressure of the fluid flowing through the bore 124. A small piston 180 along with a number of o-rings 190 seal the hydrostatic pressure chamber 175 from the lower atmospheric chamber 109. In this manner, a pressure differential is maintained between the top surface of the small piston 180 that is exposed to the wellbore fluid and the bottom surface of the small piston that is exposed to atmospheric pressure.

In operation, a signal is sent from the surface, e.g. mud pulse, pipe pinning, fiber optics, magnetically charged fluid pumped from the surface, electric wire line run internally or externally to the tool, or other method known to those in the field, that causes a battery pack (not shown) to activate the heating coil 170 which is wrapped around the wire 185 holding the small piston or plug 180. The wire 185 holding the small piston 180 is essentially keeping the hydrostatic pressure from pushing the small piston 180 into the lower atmospheric chamber 109 before it is required.

When heated, the wire 185 is weakened and eventually breaks or loosens to a point that it can no longer support the small piston 180 and the hydrostatic pressure acting upon it. Thus, the heating of the wire 185 causes the small piston 180 to enter the lower atmospheric chamber 109, exposing the piston 110 to hydrostatic pressure. As in the preferred embodiment, the hydrostatic head overcomes the force of the piston set pin 125 and causes the piston 110 to move downward and seal the bypass ports (not shown). As an alternative, a break plug 112 is attached to the lower atmospheric chamber 109. If the signal fails to activate the battery pack a tube or shear bar, as in FIG. 5, can be dropped from the surface closing the tool.

Figure 7:
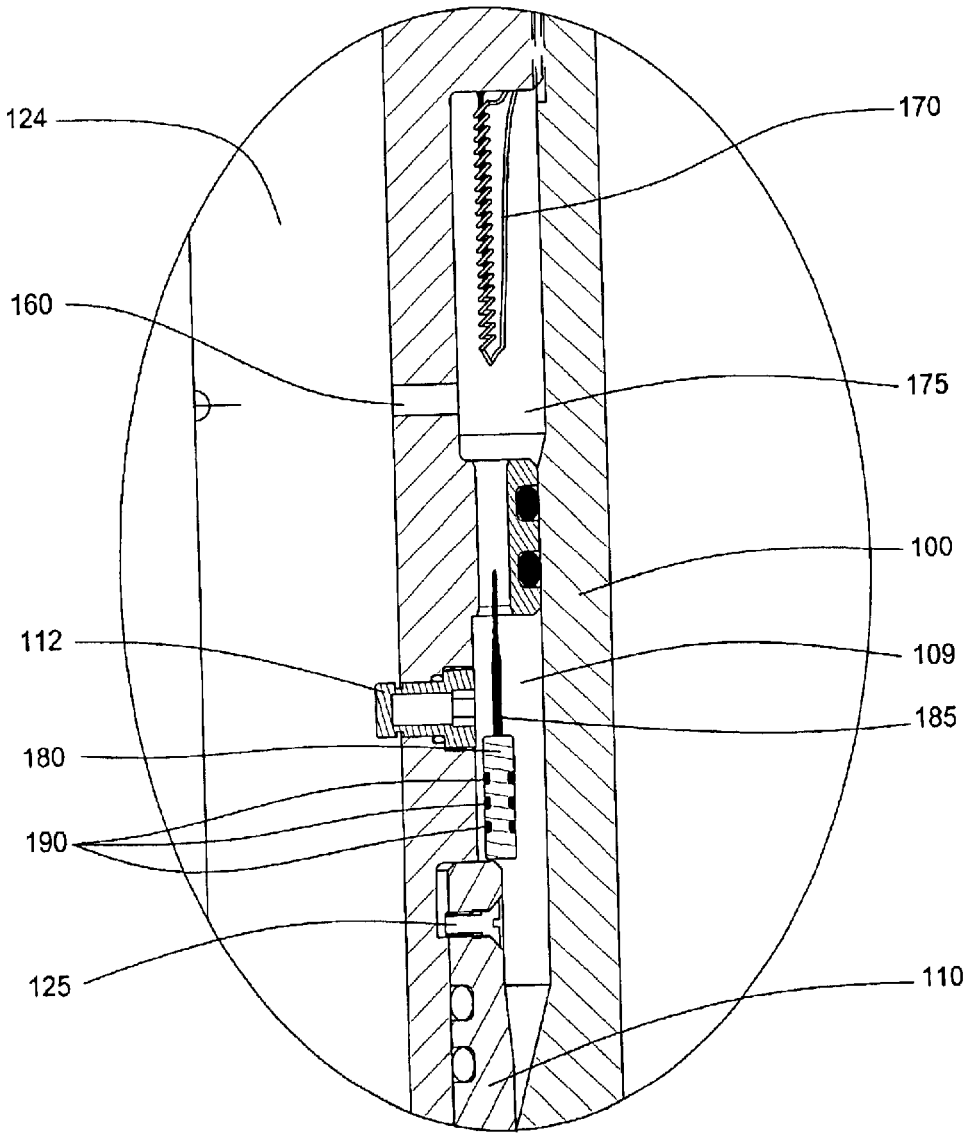
FIG. 7 is a partial section view of the electrically operated single operation tool, after the heating coil has melted or burned the wire. As shown, the small piston or plug that was being held in place and sealing the hydrostatic pressure chamber from the lower atmospheric chamber has lowered and thus allowed the welibore fluid a pathway to enter the lower atmos heric chamber.

As shown in FIG. 7, the heating coil 170 has melted or weakened the wire 185 such that the hydrostatic pressure acting upon the top surface of the small piston 180 forces the small piston 180 into the lower atmospheric chamber 109. Wellbore fluid is then allowed to make contact with the piston 110 and in the same manner as that described above, the piston 110 is forced downward and the bypass ports (not shown) are sealed.

This embodiment may also be segmented such that a series of the tool described immediately above would be connected together, thus allowing for multiple or repeatable closings and openings. A first piston would close the bypass ports in the same manner as that described above in a single signal operated device. However, a second unique operation signal could then be sent to the tool and a second piston could be operated to open a lower set of bypass ports. The lower set of bypass ports are closed when a third signal is sent from the surface to move a third piston to close the tool. Additional opening and closing segments could be mated together in order to satisfy the needs of the operators. Advantageous to this system is its repeatability, its ability to open or close the bypass fluid path more than once.

In yet another embodiment, not shown, the invention allows for multiple, or repeatable, openings and closings of the bypass ports during a single run downhole. In this embodiment, the use of a ratcheted sleeve, akin to that shown in FIGS. 4 and 5A–5F of U.S. Pat. No. 5,743,331, would allow the tool to be repeatedly set in either an open or closed position while downhole. U.S. Pat. Nos. 5,743,331, and 6,116,336 are herein incorporated by reference. U.S. Pat. Nos. 5,743,331, and 6,116,336, refer to milling systems that allow for the repeated openings and closing of annular ports through the use of a ratcheted sleeve assembly.

When running downhole it would be advantageous to be able to close the bypass ports 122 of the tool 100 if increased flow and or fluid is required in the annulus between the drill string or tool, or liner and the casing. In this embodiment, a ratcheted sleeve and accompanying piston assembly would be configured such that an operator on the surface could increases or decreases the fluid pressure in order to set the bypass ports in an open or closed position. In this manner the closing member could be selectively positioned for the desired result.

In order to accomplish the aforementioned, the tool 100, in addition to having bypass ports 122 would incorporate a piston assembly as taught in the pre-mentioned patents. The piston assembly would comprise a hollow body with a hollow piston mounted for reciprocal up and down rotative movement therein. The hollow body having an inwardly projecting lug.

The lug would project through the body into a multi-branched slot of a sleeve. A ratcheted sleeve connected to the piston having a branched slot therearound which is moveable on the lug so that the ratcheted sleeve and the piston are movable to a plurality of positions. The branch slot having a plurality of positions including a plurality of recesses and positions for setting the tool, for instance there would be at least one position for circulate, and at least one position for non-circulating. The branched slot within the ratcheted sleeve would extend around the entire sleeve for cycling the piston assembly.

In this manner, an operator on the surface could run the tool 100 downhole, and if needed could close and reopen the bypass ports 122 at any time prior to reaching his intended depth. Thus this embodiment provides for a cycling, and consequently an infinite number of openings and closings of the bypass ports 122. The operator may selectively move the closing member in a back and forth manner, opening and closing the bypass ports 122 at will.

To further describe this embodiment, the piston assembly would have a top bushing threadedly connected to the piston body. A bottom bushing would be connected to a lower end of the piston body. A piston would be movably mounted in a bore of the piston body. A spring abuts an upper end of the lower bushing and pushes against (upwardly) a thrust bearing set at a bottom of the ratchet sleeve (see FIG. 3C of the '331 patent). A thrust bearing set is disposed between a top of the ratchet sleeve and the lower end of the piston (see FIG. 3B of the '331 patent). The use of thrust bearings inhibits undesirable coiling of the spring and facilitates rotation of the ratchet sleeve. The thrust bearing sets may include a typical thrust bearing sandwiched between two thrust washers.

As described, this embodiment allows for multiple openings and closings of the bypass ports during a single run downhole by means of a piston assembly which is responsive to increases and decreases in fluid pressure from the surface in order to ratchet a slotted lug into set positions correlating to whether the bypass ports 122 are open or shut.

Figure 8:
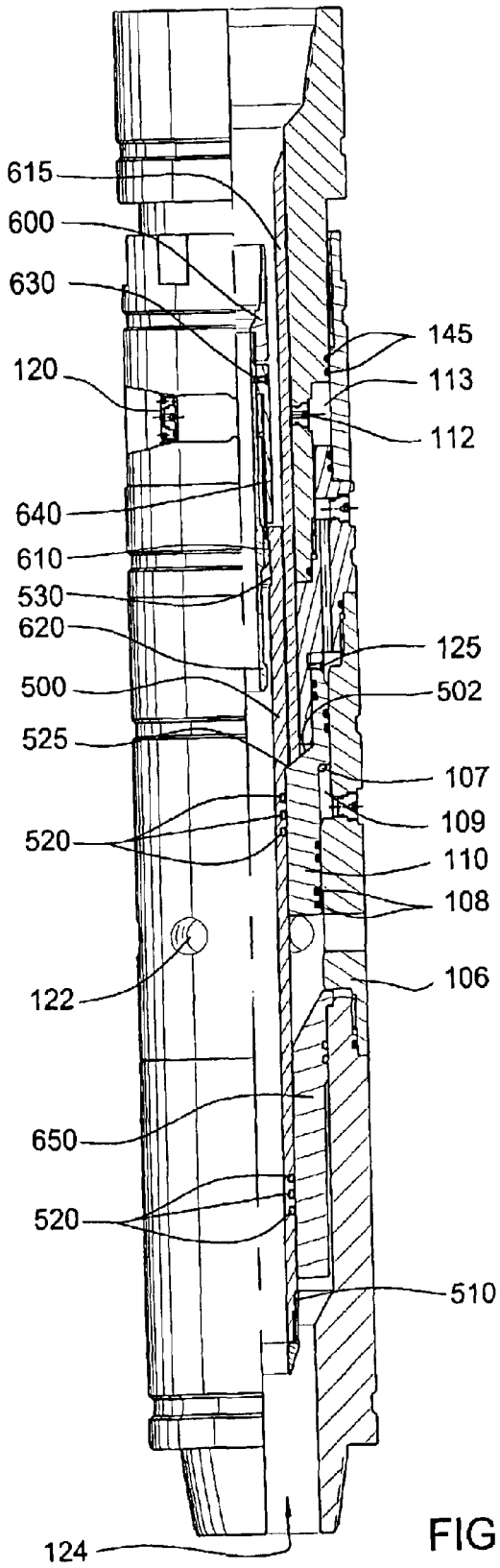
FIG. 8 is a partial section view of the tool showing an alternative non-hydraulic method of closing the bypass ports. In this view, the bypass ports are mechanically closed by way of a bridge sleeve that has been lowered from the surface by means of a running tool.

FIG. 8 is a partial section view of the tool showing an alternative non-hydraulic method of closing the bypass ports 122. In this embodiment, the bypass ports 122 are mechanically sealed by way of a bridge sleeve 500 that has been lowered from the surface by means of a running tool assembly. As a mechanical alternative, yet another alternative means, to closing the bypass ports 122 the bridge sleeve 500 may be lowered or dropped from the surface. In this manner, if the rupture disc 120 or break-plug 112 fails to either operate or close the bypass ports 122 by way of a hydraulically operated piston 110 shown in FIGS. 2–4, the bridge sleeve 500 could be lowered into the wellbore via wire-line, slick-line, coiled tubing, or other suitable means. Additionally, the bridge sleeve may be used in the event that a shear bar or tube 615 as described in FIG. 5 fails to close the bypass ports 122. During run-in, the bridge sleeve 500 attaches onto the end of the running tool. Once in position, the bridge sleeve 500 locks onto a bottom sub 650 by means of a split ring latch 510.

The bridge sleeve itself has a series of upper and lower o-rings 520 to assist in fluidly sealing the bypass ports 122. In further description, the bridge sleeve 500 comprises an upper and lower end. At the upper end, an under-cut 530 is formed so that the running tool assembly can latch onto the bridge sleeve 500. At the lower end of the bridge sleeve 500, a split-ring latch 510 is present which locks into the bottom sub 650 of the tool. The split-ring latch 510 locks the bridge sleeve 500 into the bottom sub 650 of the tool and prevents the bridge sleeve 500 from moving in an upward direction once positioned. To further prevent movement of the bridge sleeve 500, particularly in a downward direction, the bridge sleeve 500 is designed with a lip 525 that mates with an interior shoulder 502 of the piston 110. Thus, once positioned, the bridge sleeve 500 mechanically and fluidly seals the bypass ports 122.

After lowering the bridge sleeve 500 into position, the split-ring latch 510 locks into the bottom sub 650. The running tool assembly is then pulled-up on and the bridge sleeve 500 is released so that the running tool assembly can be retrieved from the wellbore leaving the bridge sleeve 500 attached and locked to the tool.

In further description, the running tool assembly comprises at least an upper body 600, a latching member 610, a mid-housing 640, and a lower body 620. A shear pin 630 holds the mid-housing 640 and lower body 620 of the running tool assembly together. The mid-housing 640 is threadedly connected to the upper body 600. Disposed between the upper and lower bodies is a latching member 610 that is designed to lock into the under-cut 530 of the bridge sleeve 500. The lower body 620 is formed with a lower profile member such that upon raising the running tool assembly, the profile member will grasp the latching member 610 and release the latching member 610 from the bridge sleeve 500.

In operation, when retrieving the running tool, an upward force shears the shear pin 630 and allows the lower body 620 to move in relationship to the latching member 610. While in movement, the lower body 620 engages the latching member 610 and the entire assembly is brought to the surface.

Figure 9:
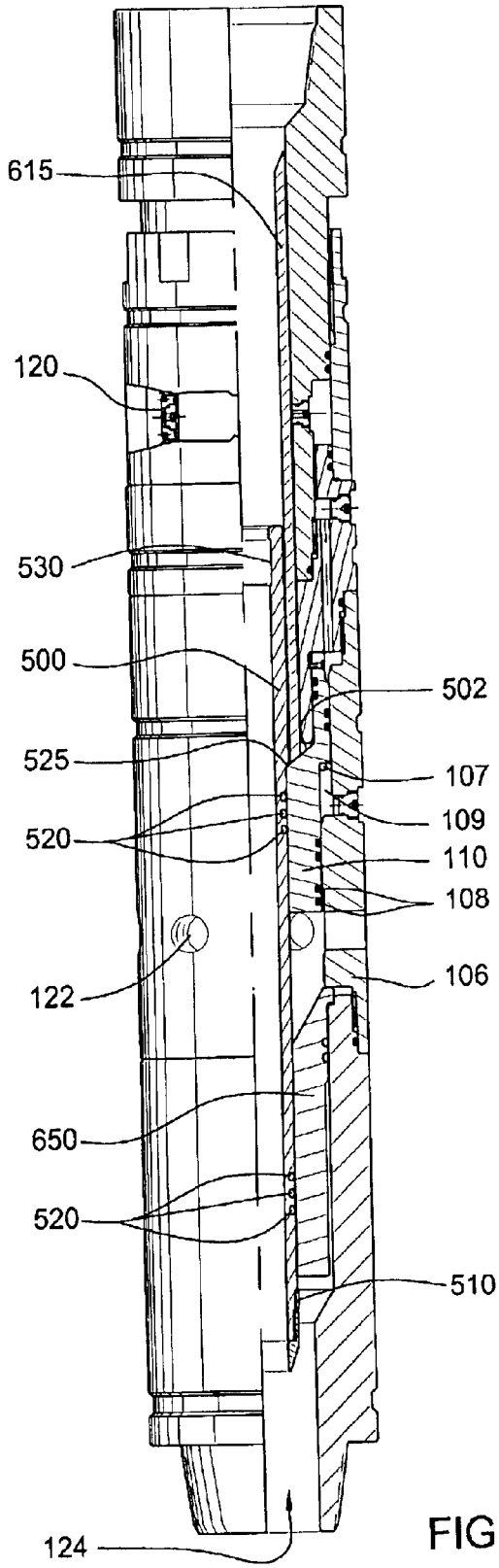
FIG. 9 is a partial section view of the previous tool showing the bridge plug in position and the bypass ports closed.

FIG. 9 is a partial section view of the previous tool showing the bridge plug in position and the bypass ports 122 closed. As shown, the bride sleeve 500 is locked into the bottom sub 650. The upper and lower o-rings 520 of the bridge sleeve ensure that the bridge sleeve 500 maintains a sealing relationship with the tool so that no fluid may flow through the bypass ports 122 when it's in position.

Figure 10:
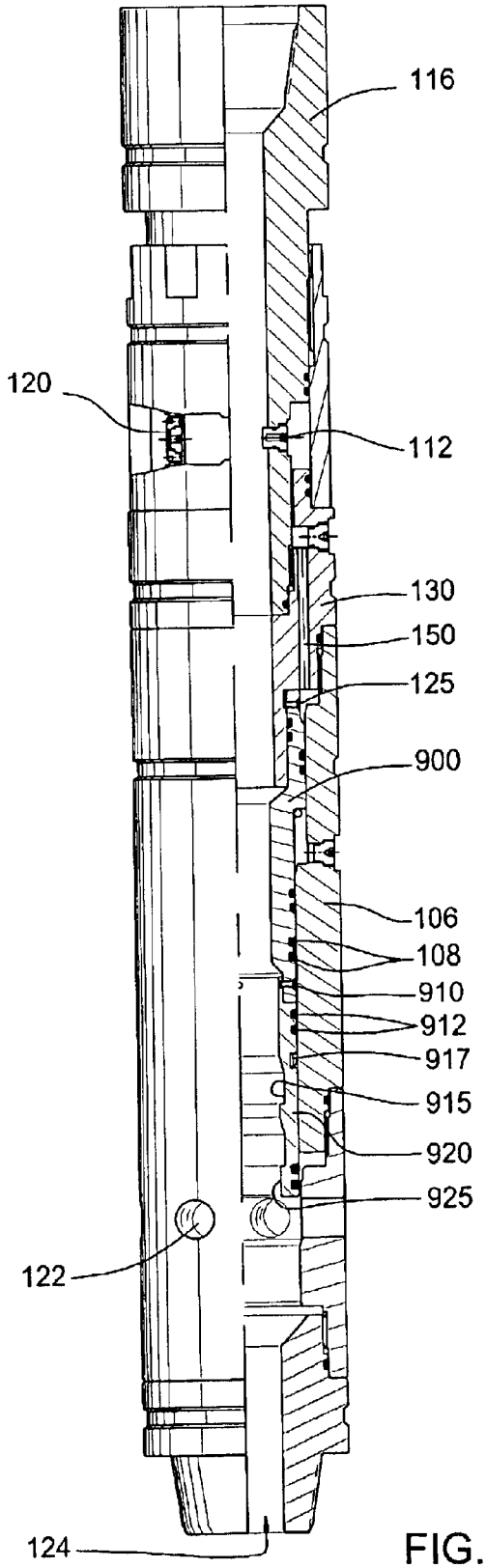
FIG. 10 is a partial section view of another embodiment of the present invention, in this case, showing another alternative non-hydraulic method of closing the bypass ports. In this embodiment, the piston sleeve consists of an upper body and a lower body connected by means of a shear pin. As visible on the lower piston body is a recess or undercut that will mate with the running tool's spring loaded dogs. The running tool will shear the lower piston body away from the upper piston body and place the lower piston body in position to seal the bypass ports.

FIG. 10 is a partial section view of another embodiment of the present invention showing an alternative non-hydraulic method of closing the bypass ports 122. In this embodiment, the piston consists of an upper body 900 and a lower body, or closing sleeve, 920 connected by means of a shear pin 910. As visible on the lower piston body 920 is a recess or undercut 915 that will mate with a key seat tool (not shown). By way of mechanical force, the key seat tool will shear the lower piston body 920 away from the upper piston body 900.

In operation, a frangible member may not operate and an alternative non-hydraulic means of closing the bypass ports 122 is needed. As described herein and above, the features of this tool 100 allow more than one means of closing the bypass ports 122.

The detachable closing sleeve 920 requires the tool to be internally modified from the previous embodiments and/or closing methods. In this design, if the tool fails to close hydraulically then the key seat tool, part of a closing mechanism, is run into the wellbore on preferably coil tubing, electric wire line, or slick line with a set down acting jar, such as a spang jar.

Figure 11:
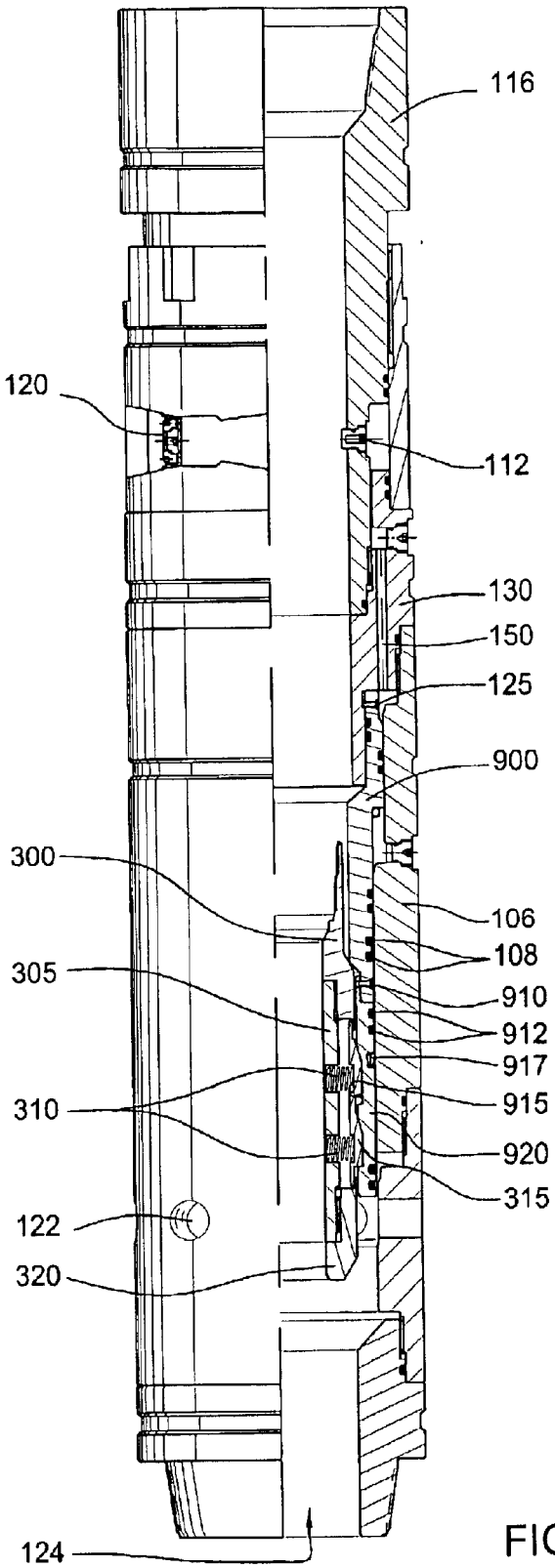
FIG. 11 is a partial section view of the previous embodiment wherein the running tool has mated with the lower piston body's recesses.

To further describe this embodiment, the key seat tool, shown in FIG. 11, typically comprises a spring loaded set of dogs that essentially spring into a specific profile. The key seat tool latches into the undercuts 915 of the lower piston body 920. Application of impacts from the jars shears the pin 910 and moves the lower piston body, or closing sleeve, 920 down to seal the bypass ports 122. The closing sleeve 122 latches into the lower sub 106 by means of a detent ring 917, and the key seat tool is then retrieved. With the key seat tool out of the hole, normal cementing operations can proceed, including the use of standard cementing darts to launch cementing plugs in the liner.

To further describe the key seat tool 300, the key seat tool comprises an upper housing, a bottom housing 320, a back plate 305, springs 310, and keys or dogs 315. The upper and lower housings are threadedly connected to the back plate 305. The back plate contains recesses or positions for springs 310. Located and placed on top of the springs 310 are keys or dogs 315. These keys are designed to mate with the undercut profiles of with the closing sleeve 920.

In operation, the key seat tool will latch onto the recess 915 of the closing sleeve 920 and with an application of force from the running tool, the closing sleeve 920 will separate from the upper piston body 900 and move into a sealingly position around the bypass ports 122. The closing sleeve 920 contains upper and lower o-rings 912 to seal the bypass ports 122. Additionally, the closing sleeve 920 also contains a detent ring 917. The detent ring 917 remains compressed while the closing sleeve 920 is in relation with the upper piston body 900, as shown. After the closing sleeve 920 has been separated from the upper piston body 900 via the key seat tool, the detent ring 917 will maintain contact with the lower sub 106 until it reaches an annulus. At that position, the detent ring 917 expands outwardly and locks the closing sleeve 920 into position. Once the closing sleeve 920 is locked in a sealingly position around the bypass ports 122, the key seat tool is disengaged from the closing sleeve 920 and brought back to the surface.

FIG. 11 is a partial section view of the previous embodiment wherein the key seat tool 300 has mated with the closing sleeve's 920 recesses or undercuts 915. The tool features a spring 310 loaded set of dogs 315 that latch into the recesses or undercuts of the inner diameter profile of the closing sleeve 915. As shown, the dogs' profiles are such that when the key seat tool 300 is retrieved from the bore 124, the dogs can disengage the closing sleeve's undercuts 915.

Figure 12:
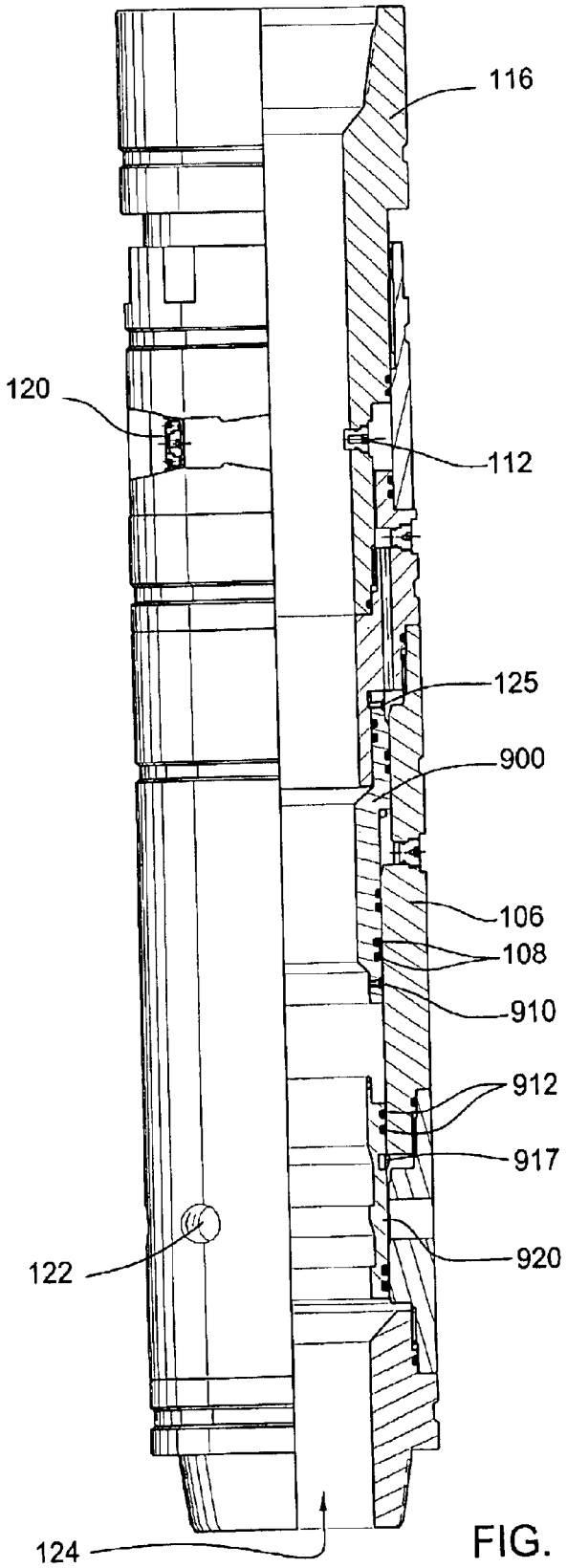
FIG. 12 is a partial section view of the tool showing the lower piston body sealing the bypass ports. As shown the lower piston body has upper and lower o-rings and a locking mechanism that prevents the lower piston body from moving longitudinally within the tool.

FIG. 12 is a partial section view of the tool showing the lower piston body or closing sleeve 920 sealing the bypass ports. As shown, the closing sleeve 920 has upper and lower o-rings 912 and a locking mechanism, a detent ring 917, which prevents the closing sleeve from moving longitudinally within the tool. In this position the closing sleeve is covering the bypass ports and along with its upper and lower o-rings 917 a fluid seal is achieved thus allowing fluid flow only through the bore 124 of the tool.

As the forgoing illustrates, the invention reduces downhole surge pressure while running a liner string into a wellbore. It achieves that result by allowing fluid which flows through the relatively large inner diameter of the liner during run-in to exit the smaller inner diameter of the run-in string and travel through the annulus between the run in string and the wellbore. More particularly, the foregoing illustrates a surge reduction tool that incorporates redundancy into the means in which the tool may be operated, as well as, incorporating repeatable openings and closings. While the foregoing is directed to the preferred embodiment of the present invention, other and further embodiments of the invention may be devised without departing from the basic scope thereof, and the scope thereof is determined by the claims that follow.

What is claimed is:

1. A method or reducing fluid surge in a tubular string, comprising:

running the string into a wellbore the string having a surge reduction apparatus, the apparatus including:

a body having a bore therethrough, the bore providing a fluid path from a lower end to an upper end of the body;

at least one fluid bypass path permitting the wellbore fluid to pass from the lower end of the body to an annular area formed between an outer surface of the body and the walls of a wellbore therearound; and whereby the at least one fluid bypass path is selectively and redundantly closable to the flow of fluid;

permitting the wellbore fluid that enters the lower end of the body during running of the string to flow through the at least one fluid bypass path; and closing the at least one fluid bypass path, whereby redundant closing includes the use of a breakable piston sleeve and at least one member of the group consisting of rupturing a disc at hydrostatic pressure and breaking a breakable plug.

2. A method of reducing fluid surge in a tubular string, comprising:

running the string into a wellbore the string having a surge reduction apparatus, the apparatus including:

a body having a bore therethrough, the bore providing a fluid path from a lower end to an upper end of the body;

at least one fluid bypass path permitting the wellbore fluid to pass from the lower end of the body to an annular area formed between an outer surface of the body and the walls of a wellbore therearound; and whereby the at least one fluid bypass path is selectively and redundantly closable to the flow of fluid;

permitting the wellbore fluid that enters the lower end of the body during running of the string to flow through the at least one fluid bypass path; and closing the at least one fluid bypass path, whereby redundant closing includes the use of a breakable piston sleeve and at least one member of the group consisting of rupturing a disc at hydrostatic pressure and transporting a sleeve from the surface.

3. A method of reducing fluid surge in a tubular string, comprising:

running the string into a wellbore the string having a surge reduction apparatus, the apparatus including:

a body having a bore therethrough, the bore providing a fluid path from a lower end to an upper end of the body;

at least one fluid bypass path permitting the wellbore fluid to pass from the lower end of the body to an annular area formed between an outer surface of the body and the walls of a wellbore therearound; and whereby the at least one fluid bypass path is selectively and redundantly closable to the flow of fluid;

permitting the wellbore fluid that enters the lower end of the body during running of the string to flow through the at least one fluid bypass path; and closing the at least one fluid bypass path, whereby redundant closing includes the use of a breakable piston sleeve and at least one member of the group consisting the use of a breakable plug and transporting a sleeve from the surface.

4. A method of reducing fluid surge in a tubular string, comprising:

running the string into a wellbore the string having a surge reduction apparatus, the apparatus including:

a body having a bore therethrough, the bore providing a fluid path between a first and second end of the body;

at least one fluid path permitting the wellbore fluid to pass between the bore and an annular area formed between an outer surface of the body and the walls of a wellbore therearound; and whereby the at least one fluid path is selectively closable to the flow of fluid by introduction of a mechanical force causing a breakable piston sleeve to displace; and closing the at least one fluid path.

5. An apparatus for reducing pressure surges in a wellbore, comprising:

a body having a bore therethrough, the bore providing a fluid path for wellbore fluid between a first and second end of the body;

at least one fluid path permitting the wellbore fluid to pass between the bore and an annular area formed between an outer surface of the body and the walls of the wellbore therearound;

the at least one fluid path being selectively closable to the flow of fluid by a first closure mechanism;

the at least one fluid path being selectively closable to the flow of fluid by a second closure mechanism; and the at least one fluid path being selectively closable to the flow of fluid by a third closure mechanism.

6. The apparatus of claim 5, wherein the first closure mechanism comprises a rupture disc.

7. The apparatus of claim 6, wherein the second closure mechanism comprises a breakable plug.

8. The apparatus of claim 7, wherein the third closure mechanism comprises a breakable piston sleeve.

9. The apparatus of claim 7, wherein the third closure mechanism comprises a sleeve.

10. A method of reducing fluid surge in a wellbore, comprising:

running the string into a wellbore, the string having a surge reduction apparatus, the apparatus including:

a body having a bore therethrough, the bore providing a fluid path between a first and second end of the body;

at least one fluid path permitting the wellbore fluid to pass between the bore and an annular area formed between an outer surface of the body and the walls of a wellbore therearound; and whereby the at least one fluid path is selectively closable to the flow of fluid by at least three different closing mechanisms; and closing the at least one fluid path.

11. The method of claim 10, wherein one of the closing mechanisms is a sleeve.

12. A bypass valve for use in a downhole assembly, comprising:

a body having a bore therethrough, the bore providing a fluid path between a first and second end of the body;

at least one fluid bypass path permitting the wellbore fluid to pass between the bore and an annular area formed between an outer surface of the body and the walls of a wellbore therearound; and a breakable piston sleeve capable of displacing to close the at least one fluid bypass path to the flow of fluid upon introduction of a mechanical force to the breakable piston sleeve.

* * * * *

UNITED STATES PATENT AND TRADEMARK OFFICE

CERTIFICATE OF CORRECTION

PATENT NO. : 6,834,726 B2
APPLICATION NO. : 10/157743
DATED : December 28, 2004
INVENTOR(S) : Richard Giroux et al.

It is certified that error appears in the above-identified patent and that said Letters Patent is hereby corrected as shown below:

Column 10

Line 66, Please remove “or” and replace with --of--.

Column 12

Line 35, Please remove “7” and replace with --5--.

Signed and Sealed this

Eighteenth Day of September, 2007

JON W. DUDAS
*Director of the United States Patent and Trademark Office*